United States Patent [19]

Freimuth et al.

[11] Patent Number: 4,853,667

[45] Date of Patent: Aug. 1, 1989

[54] WIRE ROBBIN FOR INDUCTIVE DEVICES

[75] Inventors: Lothar Freimuth, Franklin Lakes, N.J.; Raymond H. Van Wagener, Darien, Conn.

[73] Assignee: Magnetek Universal Manufacturing Corp., Paterson, N.J.

[21] Appl. No.: 187,369

[22] Filed: Apr. 28, 1988

[51] Int. Cl.[4] ..... H01F 15/10

[52] U.S. Cl. ..... 336/192; 29/605; 174/135; 439/449

[58] Field of Search ..... 336/192, 198, 208; 174/135; 29/602 R, 605; 310/71; 439/449, 457, 458

[56] References Cited

U.S. PATENT DOCUMENTS

| | | | |
|---|---|---|---|
| 3,315,198 | 4/1967 | Biesma et al. | 336/192 |
| 3,496,505 | 2/1970 | Johannson et al. | 336/192 X |
| 3,585,450 | 6/1971 | Lane | 336/192 X |
| 3,742,412 | 6/1973 | Lakin | 336/192 |
| 3,745,500 | 7/1973 | Simon | 337/192 |
| 4,238,753 | 12/1980 | Bayer | 336/192 X |
| 4,427,962 | 1/1984 | Liberman | 336/192 X |
| 4,700,167 | 10/1987 | Barankin et al. | 336/192 |

FOREIGN PATENT DOCUMENTS

| | | | |
|---|---|---|---|
| 2320820 | 11/1974 | Fed. Rep. of Germany | 336/192 |
| 58-70515 | 4/1983 | Japan | 336/192 |

OTHER PUBLICATIONS

"How Bobbin and Terminal Design Facilitate Automatic Termination of Magnetic Wire", Donald S. Lee, Insolation/Circuits, Nov. 1977, pp. 39–43.

*Primary Examiner*—Thomas J. Kozma

*Attorney, Agent, or Firm*—Darby & Darby

[57] ABSTRACT

A wire bobbin (1) for use with inductive devices is disclosed having a central core (2) about which a wire is windable, with side walls (3) and (4) oppositely disposed about the core for retaining the wire thereon. A coil of wire, wound about the core, has a wire end (20) extending through at least one side wall. The side wall further includes a first channel (7) sized to retain a lead wire (21) therein, with the channel open at both ends. A second channel (13), which is preferably directly adjacent to the first channel, communicates through an open end (9) with the first channel. The lead wire is then inserted into the first channel, with a stripped end (22) extending into the second channel. The stripped end is combined with the magnet wire end, permanently joined, such as by dip soldering, and then bent into position within the second channel. Utilizing channels on the side wall minimizes extending structures which might interfere with other structures, making these wire bobbins particularly useful in transformers with limited space.

7 Claims, 1 Drawing Sheet

WIRE ROBBIN FOR INDUCTIVE DEVICES

TECHNICAL FIELD

This invention relates to wire bobbins for inductive devices which provide an improved magnet and lead wire termination site.

BACKGROUND

An inductive device typically includes a wire surrounding a common core, with this relatively small diameter wire usually wound on a spool or bobbin. The wound wire, termed "magnet wire", becomes a magnet when charged. Transformers are typical inductive devices which transfer energy from one circuit to another by electromagnetic induction, usually utilizing a secondary winding to provide a transformed voltage output. Generally, a wire bobbin is made from plastic or some other insulating material, and comprises a wire winding center, or hub over which a wire is wound, with side walls for retaining the wire thereon.

Most wire bobbins for inductive devices include termination boxes disposed on one or both of the opposing side walls for attaching lead wires to the beginning and end of the wound wire. The pair of lead wires, which are of substantially greater diameter than the magnet wire, provide the electrical supply to the magnet wire. The termination boxes extend outwardly away from the side walls, with the boxes sized to accept a wire anchor therein. The magnet wire extends through a slot in the box for attachment to the conductive anchor, with the lead wire then inserted into an opening in the anchor which has inwardly sloped fingers which grip the lead wire to prevent withdrawal.

While such structures are acceptable in many applications, the termination boxes are quite bulky and have proven a problem in various transformer applications. For example, in a certain type ballast transformer for fluorescent light applications, a minimum profile transformer housing is required. Therefore, the wire bobbin must fit within a narrow area, yet maintain the proper width and winding depth to achieve the desired transformer output. The existing bobbin design interferes with the adjacent structures, requiring redesign of either the components or housing. Consequently, a need has arisen to provide near flush termination sites on wire bobbins for inclusion in transformers where space is limited.

SUMMARY OF INVENTION

It is an object of the present invention to provide a bobbin including near flush termination sites.

It is another object of the present invention to provide a bobbin which provides a simple, efficient way to produce end terminations without using wire anchors or other such means.

It is another object of the present invention to provide a bobbin which limits interference with other structures.

These and other objects of the present invention are achieved by providing a wire bobbin for an inductive device which includes a central core over which a magnet wire is windable, further including at least one side wall disposed normal to the core for retaining the wire thereon, with the magnet wire having an end which extends through a passage in the side wall, the end being connectable to a lead wire. The bobbin also has an end termination site which includes a first channel disposed on the side wall, parallel thereto, with the channel sized to retain a lead wire therein, the channel being open at both ends. A second channel is adjacent to the first channel and in communication therewith through an open end of the first channel. The lead wire is disposable in the first channel, with an end of the lead wire being extendable through the open end into the second channel. The magnet wire end is then wrapped around the lead wire, with the combined wires being joined by soldering. The combined wires are then bent back into the second channel, providing a simple and economical termination as the lead wire is used as the terminal.

Utilizing channels on the side wall allows near flush mounting of the lead wires on the end walls, assuring that the termination structures are generally only slightly wider than the lead wire diameter. In addition, if the first channel is properly sized and the second channel is located directly above the first channel, the combined wires may be bent in a U-shape after joining, thereby providing a degree of strain relief to prevent wire separation. Such end termination means allow use of wire bobbins in devices where space is at premium, without requiring redesign of the other transformer components.

DETAILED DESCRIPTION OF THE INVENTION

Figure 1:
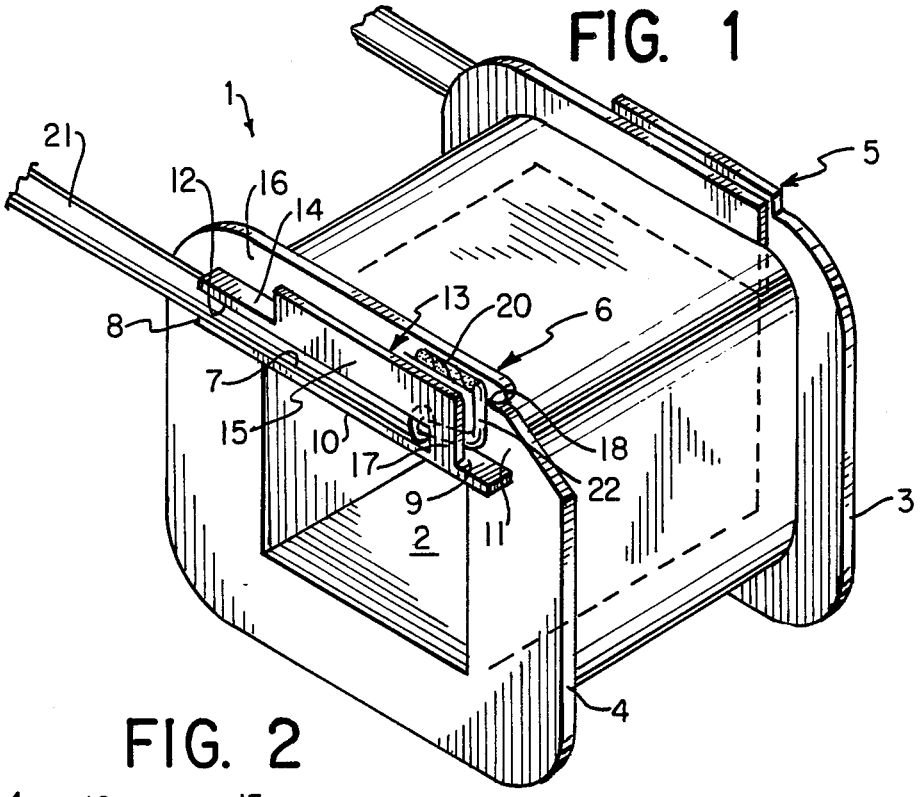
FIG. 1 is a perspective view of an embodiment of the wire bobbin of the present invention including near flush termination channels disposed on a bobbin side wall.

Referring to FIG. 1, a wire bobbin for inclusion in a transformer or other inductive device is shown. The wire bobbin 1 includes a central core 2 which may be round, square, rectangular or some other shape. The bobbin 1 further includes a first side wall 3 and a second side wall 4 oppositely attached to the central core 2. Generally, the core and side walls are integrally constructed by molding or other such means from a suitable electrical insulating material such as nylon, polypropylene or ABS plastic. However, separate manufacture and assembly of the bobbin core and side walls are also contemplated. For example, separate side walls may be attached to the core by snap fasteners, screws or other means. Each side wall is of a minimum thickness to reduce interference with other transformer structures. While two side walls are shown and described, it will be understood that a wire bobbin with only one side wall may utilize the present invention.

The wire bobbin 1 includes two wire termination sites 5 and 6 on the side walls 3 and 4, respectively. Each termination site may house a lead wire/magnet wire termination. Referring to FIG. 1, on the side wall 4, the site 6 includes a first channel 7 having an open end 8 and an open end 9. The channel 7 may be of any shape such as rounded, square, rectangular, etc. Generally, the channel may be molded integrally with the bobbin or can be cut, ground or otherwise provided in the side wall. The first channel 7, as shown, is essentially square, having an open side facing outwardly, a bottom 10, a side 11 and a top 12. The side 11 is essentially part of the bobbin wall 4. The first channel 7 is of a sufficient depth to essentially retain a lead wire therein. The open end 9 may be partially closed and include an end wall which has an aperture for passing a stripped end of a lead wire therethrough. Such an aperture may comprise a hole which approximates the stripped wire diameter. Of course, the end is more preferably fully open for ease in manufacturing the bobbin. If a hole is provided, it may also be offset slightly from the channel centerline in order provide a twist which offers some resistance to withdrawal, adding to the strain relief of the finished termination.

The open end 9 provides access to a second channel 13. The second channel is essentially "L" shaped and includes a bottom ledge 14, a partial L shaped side wall 15, and a side wall 16 which is essentially part of the side wall 4. The second channel bottom ledge 14 preferably comprises the top 12 of the first channel, with the second channel positioned above the first channel. While a partial side wall 15 is shown, it will be understood by those skilled in the art that any shape wall which provides ease in access to the wire ends may be used. In this embodiment, the L shaped wall 15 has a short leg 17 which joins to the outer edge of the first channel bottom 10. The second channel 13 is open at both ends and at the top. At one end of the side wall 16, adjacent to the open end 9 and the short leg 17, is provided a passage through which a magnet wire end may pass. As shown, the passage comprises a slot 18 in the bobbin wall 4, with the wall 4 tapered for ease in wire insertion. However, any means for providing access of the magnet wire to the second channel may be used.

Figure 2:
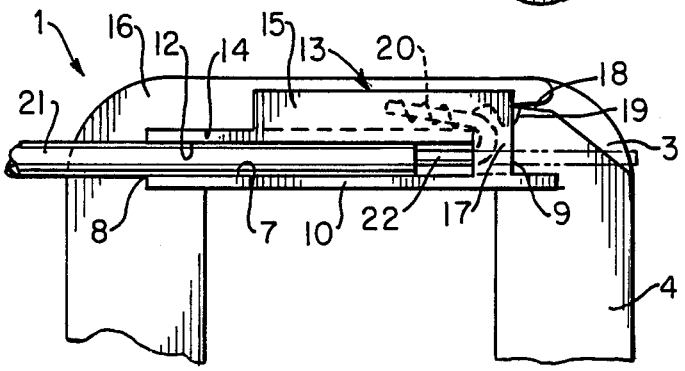
FIG. 2 is a side view of the inventive bobbin of FIG. 1, illustrating a typical termination.

Referring to FIG. 2, an enlarged view of the inventive bobbin is shown during wire joining. To make a wire termination, a magnet wire 19 is first extended through a slot (not shown) and then wound around the central core 2. An exemplary wire may comprise aluminum wire of #28 awg which is windable about the wire bobbin, in approximately 15 layers, at about 60 turns per layer. After winding, a magnet wire end 20 is passed through the slot 18 into the second channel 13.

A lead wire 21, which may comprise solid copper, of #18 awg and coated with an insulating layer, includes a stripped end 22, with the covering removed to about 2 millimeters. The lead wire 21 is then inserted into the first channel 7, with the stripped end 22 extending through the open end 9, shown in phantom. In a preferred embodiment, upon insertion of the lead wire into the first channel, the unstripped insulation abuts the short leg 17, preventing further insertion. This provides accurate positioning of the lead wire in the first channel for wire joining. The stripped wire is therefore accessible to the second channel 13. The magnet wire end 20, extending through the slot 18 in the wall 4, is wound around the stripped lead end 22 and permanently joined such as by dip soldering. This may be accomplished by combining the wires and extending them away from the bobbin, then dipping them in a solder bath. The combined wires are then bent into a U shape for positioning in the second channel, with the walls of the second channel electrically insulating the termination from contact with any other part, for example, the case in which the finally wound coil is located. This provides a simple yet effective insulation barrier.

Figure 3:
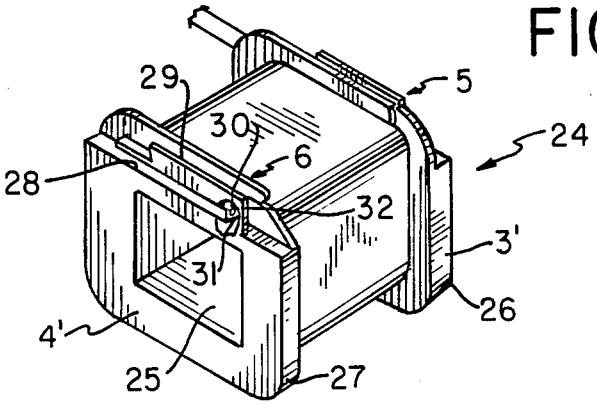
FIG. 3 shows another embodiment of the bobbin of the present invention.

Referring to FIG. 3, another embodiment of the present invention is shown. A wire bobbin 24 has a central core 25 and first and second side walls 26 and 27, respectively. In this embodiment, the side walls are of a thickness slightly greater than the lead wire thickness. Thus, a first channel 28, is provided within the thickened wall 27 to a depth sufficient to provide an essentially flat outer wall after a lead wire is inserted. Similarly, a second essentially L shaped channel 29 is provided within the thickness of the wall 27, adjacent to the first channel 28. An aperture 30 is provided in an end wall 31 of the first channel 28 to allow access of the lead wire to a short leg 32 of the second channel 29, with the aperture being slightly off center to resist wire withdrawal. Such an embodiment provides smooth bobbin side walls, minimizing interference with other structures while providing a simple and efficient means for making end terminations.

While particular embodiments are shown, it will be understood by those skilled in the art that the shape, size and length of the channels can be modified without varying from the scope of the present invention. For example, the first channel could be totally enclosed rather than having an outwardly open face.

It will be noted that utilizing such a wire bobbin which includes near flush termination sites as provided by the present invention will alow utilization of such wire bobbins in applications where space is at a premium, while retaining good electrical contact and easing attachment of the magnet wire to the lead wire. In addition, utilizing a U-shaped bend provides very effective strain relief.

What is claimed is:

1. A wire bobbin for an inductive device which includes a central core about which a wire is windable, including at least one side wall disposed normal to the central core for retaining the wire on the core, with the wire being windable about the core and having an end which is extendable through a passage in the side wall, with the end being connectable to a lead wire, the wire bobbin further including end termination means on at least one side wall comprising:

a first channel disposed on the side wall, parallel thereto, and sized to retain a lead wire therein, the channel being open at one end and having an end wall at the other end, the end wall having an aperture sized to pass a stripped lead wire end therethrough;

a second channel adjacent to the first channel and in communication with the first channel through the apertured end wall of the first channel, the wire extendable through the passage in the side wall, into the second channel, wherein a lead wire is disposable within the first channel and the stripped lead end is extendable through the aperture, with the lead wire end being combinable with the wire end, the combined wires being bendable into a U-shape and positionable in the second channel both of the channels being generally U-shaped in cross section with an open lateral side, and the second channel is essentially L-shaped with a short leg adjacent the first open end.

2. The wire bobbin of claim 1 wherein the side wall is of a sufficient thickness to provide the first and second channels therein, providing an essential smooth outer side wall surface.

3. The wire bobbin of claim 1 wherein the first channel is defined by a pair of side walls and a bottom wall.

4. The wire bobbin of claim 3 wherein one of the channel side walls comprises a bottom wall of the second channel.

5. The wire bobbin of claim 1 further comprising two oppositely disposed side walls, each side wall including end termination means.

6. The wire bobbin of claim 1 wherein the aperture is slightly offset from a centerline of the first channel.

7. The wire bobbin of claim 1 wherein the second channel is disposed above the first channel.

* * * * *